US006298211B1

(12) United States Patent
Stockman et al.

(10) Patent No.: US 6,298,211 B1
(45) Date of Patent: Oct. 2, 2001

(54) JUMP MONOCOMPONENT DEVELOPMENT ARRANGEMENT

(75) Inventors: David L. Stockman, Penfield, NY (US); Lawrence B. Schein, San Jose, CA (US)

(73) Assignee: Aetas Technology Corporation, Irvine, CA (US)

( * ) Notice: Subject to any disclaimer, the term of this patent is extended or adjusted under 35 U.S.C. 154(b) by 0 days.

(21) Appl. No.: 09/578,926

(22) Filed: May 25, 2000

(51) Int. Cl.[7] ..... G03G 15/08
(52) U.S. Cl. ..... 399/285
(58) Field of Search ..... 399/162, 159, 399/285, 265; 430/103, 120

(56) References Cited

U.S. PATENT DOCUMENTS

| | | | | |
|---|---|---|---|---|
| 4,277,551 | * | 7/1981 | Sonnonstine et al. | 430/120 |
| 4,629,669 | | 12/1986 | Shoji et al. . | |
| 5,112,709 | * | 5/1992 | Yamazaki et al. | 430/46 |
| 5,450,172 | * | 9/1995 | Suzuki et al. | 399/223 |
| 5,660,960 | | 8/1997 | Kinoshita et al. . | |
| 5,729,800 | | 3/1998 | Ohba et al. . | |
| 5,737,671 | | 4/1998 | Watanabe . | |
| 5,824,444 | | 10/1998 | Kinoshita et al. . | |
| 5,824,445 | | 10/1998 | Ochiai et al. . | |

FOREIGN PATENT DOCUMENTS 63-063061 * 3/1988 (JP) .

* cited by examiner

*Primary Examiner*—Robert Beatty
(74) *Attorney, Agent, or Firm*—BakerBotts, LLP

(57) ABSTRACT

A jump monocomponent development arrangement includes a dielectric photoreceptor belt having an image-bearing surface on one side and a conductive surface on the other side with a thickness in the range from 30 microns to 50 microns and an electrostatic charge image on the image-bearing surface has a contrast potential of 1000 to 2000 volts. Toner particles with an average diameter in the range from one micron to 20 microns are transferred from a developer roll to the electrostatic charge image using a bias potential in the range from 500 volts to 1500 volts across a development gap in the range from 100 microns to 500 microns. The difference between the maximum development voltage and the threshold development voltage is less than the contrast potential.

12 Claims, 2 Drawing Sheets

JUMP MONOCOMPONENT DEVELOPMENT ARRANGEMENT

BACKGROUND OF THE INVENTION

This invention relates to electrophotographic systems utilizing jump monocomponent development.

In electrophotographic imaging systems an electrostatic charge image is formed on the surface of a photoconductive insulating member which is conductive when exposed to light and insulating in the dark by first applying an electrostatic charge uniformly to the surface to the layer in the dark and then exposing the layer to a light image. Thereafter, the electrostatic charge image is made visible by applying toner which adheres to the charge image portions but not to the uncharged portions of the surface and the resulting toner image is then transferred to a substrate such as paper.

In two-component development systems, insulating toner particles having an electrostatic charge are carried by carrier particles to the surface containing the charge image and the toner particles are deposited on the image from the carrier particles which are then removed.

In another development process, called monocomponent development, there are no carrier particles and the toner particles are deposited on the surface containing the charge image from a developer roller which passes adjacent to the surface containing the charge image. In one form of monocomponent development the toner particles are retained on the development roller by electrostatic adhesion and the development roller is spaced by a gap from the surface containing the charge image so that the toner particles must jump from the development roller to the image-bearing surface. In order to overcome the adhesion of the toner particles to the developer roller and facilitate jumping of the toner particles to the adjacent electrostatic charge image, an electric potential is applied between the developer roller and the image-bearing layer. The magnitude of that potential depends on the width of the gap between the image-bearing surface and the surface of the development roller and must be high enough to cause the toner particle to jump to the electrostatic image portions of the surface but not to the non-image portions of the surface. If the potential difference between the developer roller surface and the image-bearing surface is too high, however, the air in the gap between the developer roller and the image-bearing surface may become ionized and cause arcing between the developer roller and the image-bearing surface.

The voltage difference between the threshold voltage which is the voltage that is just sufficient to cause the toner particles to jump to the image-bearing surface and the maximum permissible voltage which is the voltage that will not produce arcing or cause particles to jump to non-image areas is called the voltage width, and the electrostatic image potential minus the background potential on the photoreceptor is called the contrast potential. One approach to assuring effective jump development without causing arcing or deposition in non-image areas is to increase the gap between the developer roller and the image-bearing surface until the voltage width approaches but does not exceed the contrast potential. This approach, however, does not tolerate significant variations in contrast potential or in the size of the development gap. Another possible approach is to reduce the charge on the toner particles and maximize the size of the toner particles so as to minimize adhesion forces between the toner particles and the developer roller but this increases the possibility that toner particles might be transferred to nonimage portions of the photoreceptor surface.

U.S. Pat. No. 4,629,669 discloses jump monocomponent development using magnetic toner particles held on the developer roller by magnets within the roller.

U.S. Pat. No. 5,737,671 discloses an electrophotographic photoreceptor which includes a transparent substrate, a transparent conductive layer coated on the transparent substrate, and a thin film intermediate layer made of semiconductor material or semiconductive insulating material having a band gap of 2.4 eV or larger. The thin film intermediate layer is applied by a vacuum deposition method and layered on the transparent conductive layer, and an amorphous silicon photoconductive layer is layered on the thin film intermediate layer. This electrophotographic photoreceptor is used in an image forming method which includes an exposure/developing step for carrying image exposure with an exposure device located on the transparent substrate side of the photoreceptor and, at substantially the same time, carrying out image development with a bias voltage applied to the photoreceptor by a developing device provided on the other side of the electrophotographic photoreceptor.

U.S. Pat. No. 5,824,445 discloses a process for producing an image which includes the steps of electrically charging a photoreceptor in the dark, forming a latent image on the photoreceptor by selective imagewise exposure to light, and developing the latent image on the photoreceptor with a two-component developer using a magnetic carrier using which requires a photoreceptor with a conductive substrate and a photoconductive layer of amorphous silicon with a thickness of 25 $\mu$m or less.

U.S. Pat. Nos. 5,660,960 and 5,824,444 disclose an image forming apparatus containing a photoreceptor which includes an endless transparent support layer coated with a transparent conductive layer, a charge carrier generation layer and a charge carrier transport layer in which the thickness of the charge transport layer is selected to provide desired charge mobility.

Schein, *Electrophotography and Development Physics*, Rev. 2d Ed., p. 137 (1996), discusses the relations between photoreceptor thickness and developer roller voltage in jump development, showing that the developed mass per unit area can be represented by the equation:

$$M/A=V\epsilon_0/[Q/M(d_s/K_s+\Lambda/\nu)],$$

where:

M/A=Developed mass per unit area

V=Applied Voltage $\epsilon_0$=Permitivity Constant

Q=Charge $d_s$=OPC Thickness $K_s$=Dielectric Constant of OPC $\Lambda=L/K_E$ (Development Gap divided by Effective Dielectric Constant)

$\nu$=Speed Ratio

SUMMARY OF THE INVENTION

Accordingly, it is an object to the present invention to provide a jump monocomponent development arrangement for developing electrostatic charge images with overcomes disadvantages of the prior art.

Another object of the invention is to provide a jump monocomponent development arrangement providing improved image quality.

These and other objects of the invention are attained by providing a photoreceptor layer having a thickness which is great enough to provide a contrast potential that is greater than the voltage width for a given developer gap, thereby allowing the developer roller bias potential to be independent of the threshold voltage. In a preferred embodiment of the invention the thickness of the image bearing layer is greater than 30 microns, preferably in the range from about 30 microns to about 50 microns and desirably about 40 microns. This increases the contrast potential from the usual 700 volts to a value in the range from about 1,000 to 2,000 volts.

BRIEF DESCRIPTION OF THE DRAWINGS

Further objects and advantages of the invention will be apparent from a reading of the following description in conjunction with the accompany drawings in which.

DESCRIPTION OF PREFERRED EMBODIMENTS

Figure 1:
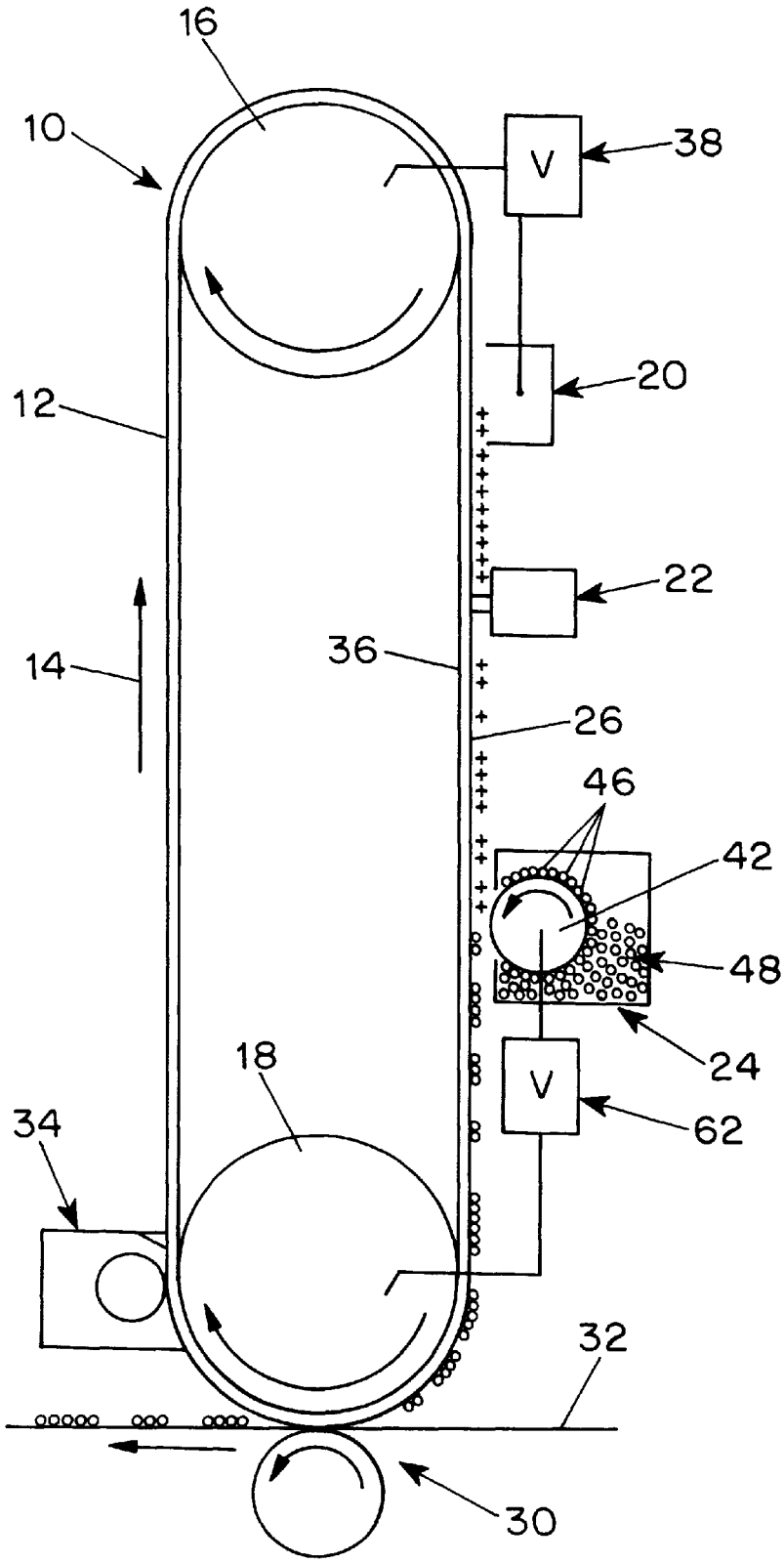
FIG. 1 is a schematic diagram illustrating a representative embodiment of an electrophotographic imaging system utilizing a jump monocomponent development arrangement in accordance with the invention.

In the representative embodiment of the invention shown in FIGS. 1 and 2, an electrophotographic imaging system 10 includes a photoreceptor member 12 in the form of a continuous belt which is conveyed in an endless loop path in the direction indicated by the arrow 14 by two drive rolls 16 and 18 past a charging station 20, an exposure station 22, and a developing station 24 in succession to produce a toner image on the outer surface 26 of the belt which is subsequently transferred at an image transfer station 30 to a substrate 32 such as a sheet of paper. A cleaning station 34 following the transfer station 30 removes any excess toner from the surface 26 of the photoreceptor 12. It will be understood that several successive groups of charging, exposure, and development stations arranged to produce different color images may be provided in the path of motion of the photoreceptor so as to produce a multicolor image which is subsequently transferred to the substrate 32.

The inner surface 36 of the photoreceptor 12 has a conductive layer which is coupled through the drive roll 36 to a potential source 38 having its positive terminal coupled to the charging unit 20 so as to control the potential level of the charge applied by the charging unit 20 to the outer surface 26 of the photoreceptor as it passes adjacent to the charging unit 20. The potential level of the charges should be sufficient to assure a contrast potential of an electrostatic charge image on the surface, i.e., the difference between the image potential and the background potential, in the range from about 1000 volts to about 2000 volts. The uniformly charged outer surface 26 is then subjected to image illumination at the exposure station 22 which may, for example, contain an LED array, to dissipate charges in selected regions of the outer surface 26 of the photoreceptor, thereby producing an electrostatic charge image on that surface. The electrostatic charge image is then moved past the developing station 24 in which a rotating developer roller 42 electrostatically attracts insulating toner particles 46 from a toner supply 48 and carries them past a doctor blade 50 which controls the thickness of the resulting layer 52 of toner particles 46 on the surface of the developer roller 42 as it moves towards the adjacent surface 26 of the photoreceptor 12.

Figure 2:
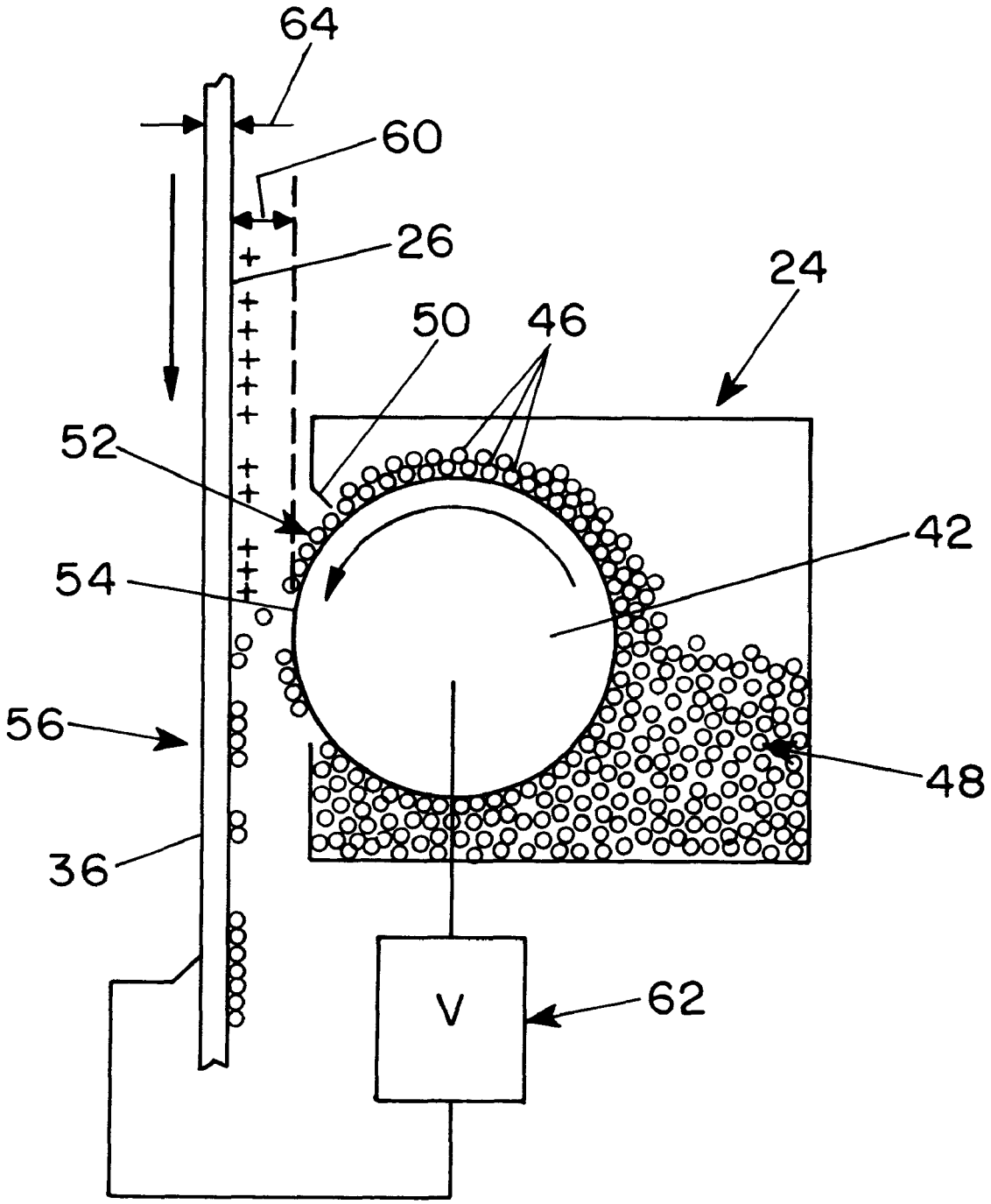
FIG. 2 is an enlarged schematic diagram showing the jump monocomponent development arrangement of the system illustrated in FIG. 1 in greater detail.

At the developing station 24, as best seen in the enlarged view of FIG. 2, individual toner particles 46, which are retained by electrostatic adhesion on the surface 54 of the developer roller 42, are carried to a development location 56 at which the developer roller surface 54 is spaced from the imaging surface 40 of the photoreceptor belt by a predetermined gap 60, which may be on the order of 100 to 500 microns, for example, and preferably about 200 microns to about 300 microns. The toner particles 46 have an average diameter preferably in the range from about one micron to about 20 microns and desirably in the range from about 5 microns to about 15 microns. In order to induce toner particles 46 to jump across the gap selectively toward the charged portions of an electrostatic charge image on the surface 26 of the photoreceptor while avoiding any transfer of toner particles to those parts of that surface which do not contain the electrostatic charge image, a potential source 62 applies a bias voltage of about 500 volts to about 1500 volts, and preferably about 750 volts to about 1000 volts, between the developer roller 42 and the conductive surface 36 on the opposite side of the photoreceptor belt 12.

Although positive symbols are used to indicate the charged portions of the image-bearing surface 26 of the photoreceptor in the schematic illustrations shown in the drawings, it will be understood that a negative charge image can also be developed in accordance with the invention by reversing the polarities of the potential sources 38 and 62.

In accordance with the invention, the thickness 64 of the photoreceptor belt is selected to provide a contrast potential, i.e., a potential difference between the potential of the charge image on the photoreceptor surface 26 and the background potential of the surface 26, which is in a range from about 1,000 to about 2,000 volts, which is much greater than the customary contrast potential of about 700 volts. This increase in contrast potential is achieved by increasing the thickness of the photoreceptor belt from the usual thickness of about 20 to 25 microns to at least 30 microns, preferably in the range from about 30 to 50 microns, and desirably about 40 microns.

As a result of the increase in contrast potential, the bias potential provided by the potential source 62 is independent of the threshold voltage as long as the gap 60 is maintained constant. Consequently, the voltage width, i.e., the difference between the threshold voltage and the maximum developer roller voltage, is less than the contrast potential. This results in a minimum voltage width for jump monocomponent development.

Although the invention has been described herein with reference to specific embodiments many modifications and variations therein will readily occur to those skilled in the art. Accordingly, all such variations and modifications are included within the intended scope of the invention.

We claim:

1. A jump monocomponent development arrangement comprising:

a dielectric photoreceptor member having an image-receiving surface on one side to convey an electrostatic charge image adjacent to a development station and having a conductive surface on the opposite side;

a development station including a developer roller having a toner-carrying surface separated by a development gap from the image-receiving surface of the photoreceptor member to apply toner particles to an electrostatic charge image thereon by jump development; and a potential source providing a bias potential between the developer roller and the conductive surface of the photoreceptor member; wherein the thickness of the dielectric photoreceptor member is selected to provide a contrast potential which is greater than the voltage width of the electrostatic charge image on the image-receiving surface of the photoreceptor member during development.

2. A jump monocomponent development arrangement according to claim 1 wherein the toner particles adhere to the developer roller by electrostatic adhesion prior to transfer to the image-bearing surface of the photoreceptor member.

3. A jump monocomponent development arrangement according to claim 1 wherein the thickness of the photoreceptor member is at least about 30 microns.

4. A jump monocomponent development arrangement according to claim 3 wherein the thickness of the photoreceptor member is in the range from about 30 microns to about 50 microns.

5. A jump monocomponent development arrangement according to claim 4 wherein the thickness of the photoreceptor member is at about 40 microns.

6. A jump monocomponent development arrangement according to claim 1 wherein the contrast potential of the electrostatic charge image on the image-bearing surface is in the range from about 1000 volts to about 2000 volts.

7. A jump monocomponent development arrangement according to claim 1 wherein the toner particles have an average diameter in the range from about 1 micron to about 20 microns.

8. A jump monocomponent development arrangement according to claim 1 wherein the toner particles have an average diameter in the range from about 5 microns to about 15 microns.

9. A jump monocomponent development arrangement according to claim 1 wherein the development gap is in the range from about 100 microns to about 500 microns.

10. A jump monocomponent development arrangement according to claim 9 wherein the development gap is in the range from about 200 microns to about 300 microns.

11. A jump monocomponent development arrangement according to claim 1 wherein the potential source provides a bias potential in the range from about 500 volts to about 1500 volts.

12. A jump monocomponent development arrangement according to claim 1 wherein the potential source provides a bias potential in the range from about 750 volts to about 1000 volts.

* * * * *